United States Patent [19]

Beach et al.

[11] Patent Number: 4,771,292

[45] Date of Patent: Sep. 13, 1988

[54] SUSPENDED ANTENNA WITH DUAL CORONA RING APPARATUS

[75] Inventors: Glenn R. Beach, Howard County; Marcus Slobins, Montgomery County; Myron S. Wheeler, Catonsville, all of Md.

[73] Assignee: The United States of America as represented by the Secretary of the Air Force, Washington, D.C.

[21] Appl. No.: 937,957

[22] Filed: Dec. 4, 1986

[51] Int. Cl.[4] ..... H01Q 1/30; H01B 17/44

[52] U.S. Cl. ..... 343/707; 343/885; 174/140 CR

[58] Field of Search ..... 343/706, 707, 708, 877, 343/885; 174/140 CR

[56] References Cited

U.S. PATENT DOCUMENTS

| | | | |
|---|---|---|---|
| 3,944,720 | 3/1976 | Tailler | 174/73 R |
| 3,999,185 | 12/1976 | Polgar, Jr. et al. | 343/709 |
| 4,220,956 | 9/1980 | Sanford | 343/706 |
| 4,255,615 | 3/1981 | Huang et al. | 174/140 CR |
| 4,413,165 | 11/1983 | Schultz | 174/140 CR |
| 4,476,576 | 10/1984 | Wheeler et al. | 455/97 |
| 4,633,263 | 12/1986 | Altshuler | 343/706 |

FOREIGN PATENT DOCUMENTS

| | | | |
|---|---|---|---|
| 3236910 | 4/1984 | Fed. Rep. of Germany | 174/140 CR |

*Primary Examiner*—William L. Sikes
*Assistant Examiner*—Doris J. Johnson
*Attorney, Agent, or Firm*—William G. Auton; Donald J. Singer

[57] ABSTRACT

The aerostat-supported antenna/tether cable of a communication system is protected from destructive corona discharges by a dual corona ring assembly which attaches the feed cable of the transmitter to the antenna. The voltage divider assembly includes upper and lower corona rings which have a space between them which is an isolated and corona-free attachment point for the feed cable. By attaching the voltage divider assembly to the antenna/tether cable at about 12 to 15 feet above the ground, the base of the antenna/tether cable distributes the feed voltage along its length to levels below those voltage levels in which destructive ionization may occur.

8 Claims, 2 Drawing Sheets

SUSPENDED ANTENNA WITH DUAL CORONA RING APPARATUS

STATEMENT OF GOVERNMENT INTEREST

The invention described herein may be manufactured and used by or for the Government for governmental purposes without the payment of any royalty thereon.

BACKGROUND OF THE INVENTION

This invention relates to communications systems, and particularly to one using a balloon tether as a long antenna for very low frequency transmission. It relates specifically to the attachment mechanism used for connecting the VLF transmitter to a vertically suspended antenna/tether cable.

Communications systems operating at high frequencies utilize a physically large tower as a monopole antenna or to support a monopole antenna. At very low frequencies, a tower is physically and economically impractical. The reason for this is that ideally, the antenna should be a quarter wavelength in height. However, a very low frequency (VLF) system operating at 61 kHz would need an antenna over 4,000 feet high.

Exemplary in the art of VLF communications systems is the disclosure of U.S. Pat. No. 4,476,576 issued to Myron S. Wheeler et al, the disclosure of which is incorporated by reference. Wheeler et al disclose a VLF communication system that uses an aerostat to support a cable that serves as both a tether and an antenna.

The electromechanical cable used in the VLF communication of Wheeler et al is directly connected to a winch, which deploys it, and is electrically connected to a VLF transmitter. The VLF transmitter can operate at voltages of about 62 kv. During operation, there exists a requirement to protect the tether base from the effects of high voltage. More specifically, corona discharges from the high voltage can cause a failure of the antenna by destructive ionization at the point where the feed cable from the transmitter connects with the antenna.

From the foregoing discussion, it is apparent that there currently exists the need to protect the antennas of VLF communication systems from corona discharges. The present invention is intended to satisfy that need.

SUMMARY OF THE INVENTION

The present invention is an attachment device for connecting a very low frequency transmitter to a vertically suspended antenna/tether cable. One embodiment of the invention uses a dual corona ring construction as a dual corona ring assembly to attach the feed cable from the VLF transmitter to the antenna/tether cable and shield the base of the antenna from destructive corona discharges.

The antenna/tether cable passes through the center of the dual corona ring construction. The amount of cable beneath this dual corona ring is simply a tether connected to a winch or similar mooring. The cable above the dual corona ring is the VLF antenna supported by an aerostat, as described in the Wheeler et al reference.

The dual corona ring construction is composed of upper and lower corona rings which are spaced apart from each other by a frame. This frame is composed of a system of tubes which electrically and mechanically connect the upper and lower corona rings to each other, and permit the feed cable to connect to the tether in a field-free region between the rings. Each corona ring is composed of a hollow, thin-walled polyester and fiberglass cloth ring which is coated with an aluminum paint or flame-sprayed metallic compound and connected to the tether cable by center reinforcement ribs.

In one particular embodiment, the upper and lower corona rings each have a slot which permits the antenna/tether cable to be slipped into the dual corona rings quickly. This embodiment also uses a number of quick-lock clamps as part of its center reinforcement rib structure to connect with the antenna/tether cable. The space between the two rings is an isolated area which is corona-free for attachment hardware and for making feed line connections to the antenna/tether cable.

It is an object of the present invention to provide a means for protecting vertically suspended antenna/tether cables from destructive corona discharges.

It is another object of the present invention to provide a lightweight protection system that quickly connects with VLF cable antennas which are supported by an aerostat.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention is a dual corona ring attachment mechanism which may be used to attach a retractable antenna feed cable to a vertically suspended antenna/tether cable of a VLF communication system.

Figure 1:
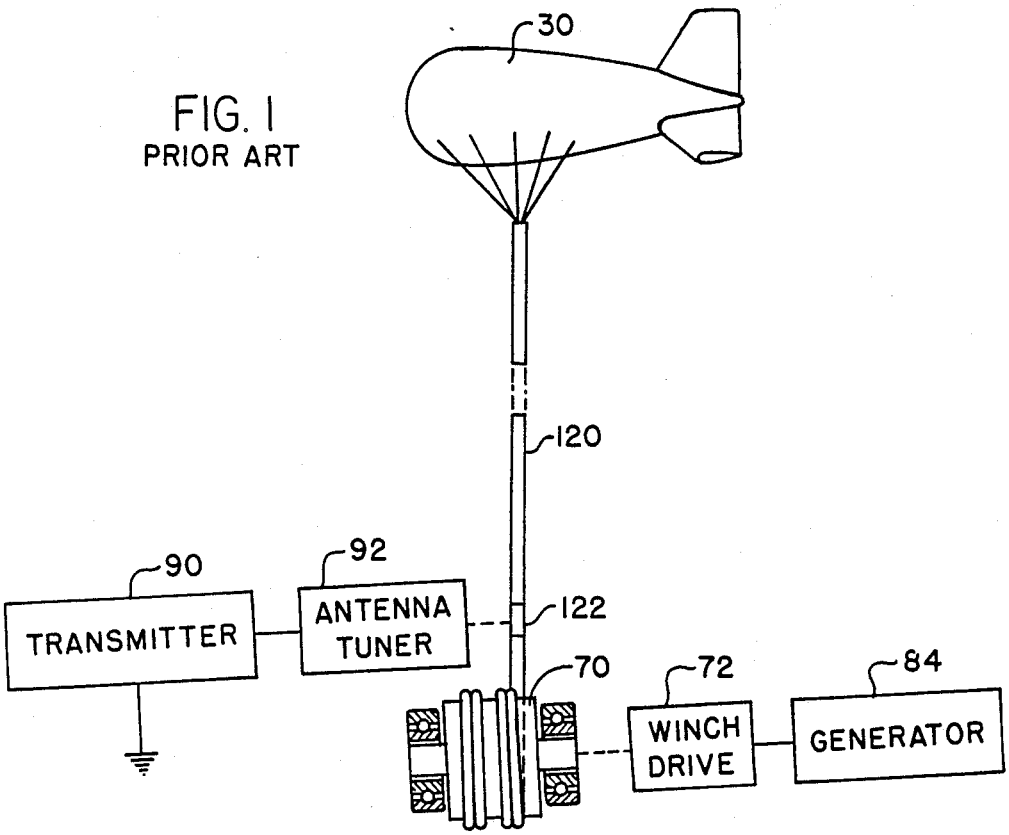
FIG. 1 PRIOR ART
FIG. 1 is an illustration of a prior art VLF communication system.

The reader's attention is now directed towards FIG. 1, which is an illustration of the VLF communication system of the Wheeler et al reference. As pictured in FIG. 1, an aerostat 30 supports an antenna/tether 120 which is mechanically connected to a winch 70 and is electrically connected to a transmitter 90. The antenna/tether is supported so that its height may approach a quarter wavelength of the VLF frequency selected.

In a system such as depicted in FIG. 1, the antenna height may reach 4,000 feet while the transmitter output may be as high as 100 kv. Experience has shown that the use of such transmitter voltages generates the need to protect the base of the antenna from corona discharges, as discussed above. The present invention, as described below, provides such protection.

Figure 2:
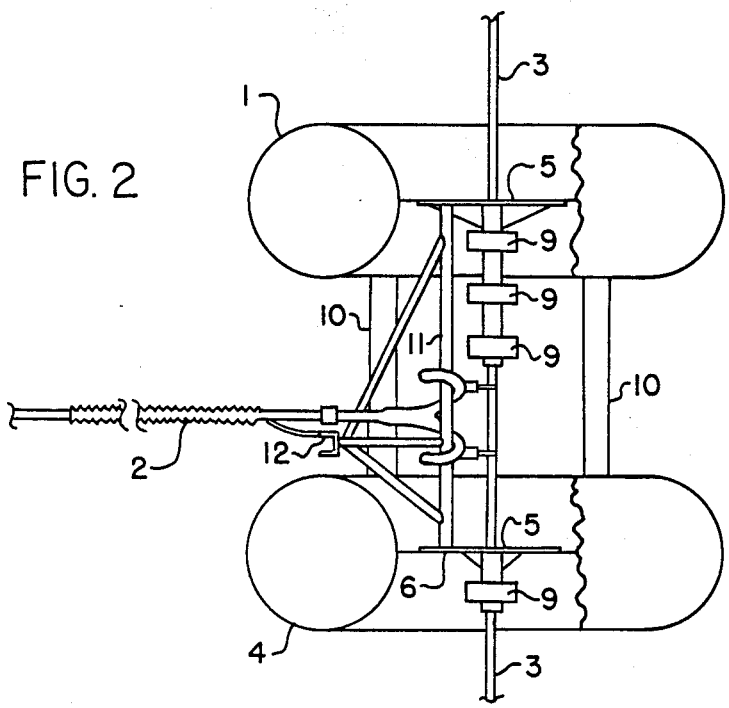
FIG. 2 is an illustration of the present invention.

FIG. 2 is an illustration of the dual corona ring construction of the present invention. The system of FIG. 2 is used to electrically and mechanically connect a feed cable 2 to the antenna/tether cable 3 of a VLF communication system, such as the one of FIG. 1.

The system of FIG. 2 protects the antenna/tether cable 3 from destructive corona discharges by providing an electrical connection to the feed cable 2 which is sheltered between two corona rings 1 and 4. These corona rings shield the base of the antenna/tether cable 3 from destructive corona discharges and provides a protected and fast-fastening attachment point for the feed cable 2 as well.

The particular VLF communication system used with the dual corona ring assembly of FIG. 2 has a transmitter which outputs a 62 kv signal over the feed cable. By attaching the present invention at a point of 12 to 15 feet along the insulated length of the tether above ground, the electric field strength at the base of the antenna/tether is reduced to an electric field strength of 1200 volts/inch. This is a threshold value at which the destructive ionization discussed above does not occur. Performance approaches the ideal, very large flat plate field value of 430 volts/inch, computed as follows:

$$\frac{62{,}000 \text{ volts}}{12 \text{ ft.} \times 12 \text{ in.}} = 430 \text{ volts/inch} \quad (1)$$

Returning to the illustration of FIG. 2, the upper and lower corona rings 1 and 4 and frame tubes 10 are each composed of a hollow, thin-walled polyester and fiberglass cloth ring which is coated with a conductive surface and is supported by center reinforcement ribs 5 and 6. The antenna/tether cable 3 passes through the center of the corona rings 1 and 4, and is clamped in place using a number of quick-lock clamps. These clamps are discussed in further detail below.

The two corona rings are electrically and mechanically connected to each other by a frame of tubes 10 which hold them in position. The feed cable 2 is electrically and mechanically attached at a vertical strut 11 and is clamped in place by clamp 12 to the dual corona ring assembly. This strut 11 is fixed to the rigid center reinforcement ribs 5 and 6 of the upper and lower corona rings 1 and 4. The dual corona ring assembly system of FIG. 2 provides an isolated area between the upper and lower corona rings which is corona-free for the attachment of the feed cable 2 to the antenna/tether cable 3.

Figure 3:
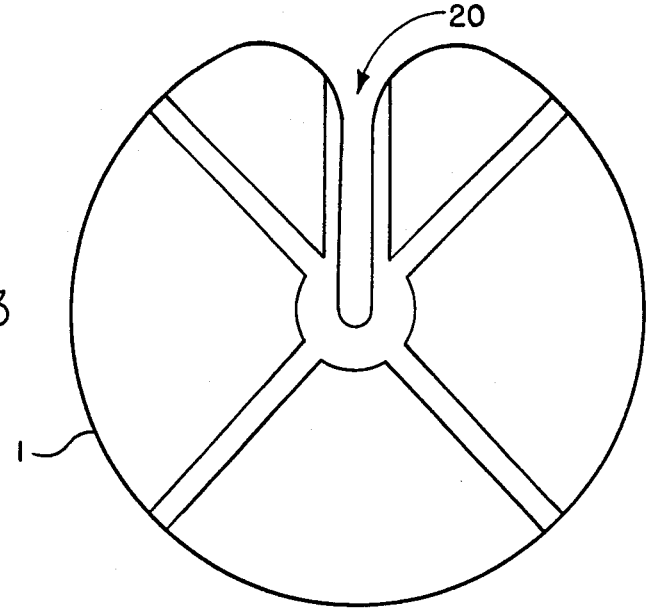
FIG. 3 is a plan view of a corona ring of the present invention.

FIG. 3 is a plan view of the preferred embodiment of the upper corona ring 1 of the dual corona ring assembly of FIG. 2. In the embodiment of FIG. 3, both the upper and lower corona rings have a slit 20 which permits the dual corona ring assembly to be attached to the antenna/tether cable at any point. This embodiment is distinct from one in which each corona ring is an unbroken annular ring assembly. An unbroken annular ring assembly can only be attached to a tether cable by passing an end of the cable through the center hole. The embodiment of the invention of FIG. 3 is attachable to the tether cable by sliding it through the slits into a portion in the center of the assembly, and clamping the quick-lock clamps to the cable.

Figure 4:
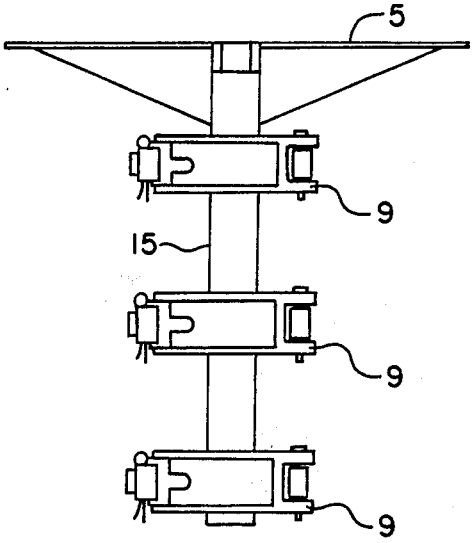
FIG. 4 is side view of the center reinforcement ribs used in a corona ring.

FIG. 4 is a side view of the center reinforcement rib structure 5 used in the embodiment of FIG. 2. The center reinforcement ribs 5 provide rigid support to the corona rings and serve to mechanically and electrically connect the voltage divider assembly to the antenna/tether cable. When the corona ring has the slit, as depicted in FIG. 3, the rib assembly 5 and its center tube 15 also has a slit aligned with the slit in the corona ring to permit the dual corona ring assembly to easily attach with the antenna/tether cable anywhere along its length.

Figure 5:
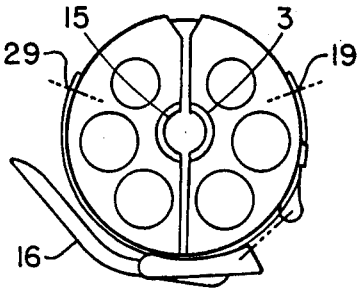
FIG. 5 PRIOR ART
FIG. 5 is a plan view of a prior art quick-lock clamp used in the present invention.

FIG. 5 is a plan view of one of the quick-lock clamps used in the present invention. When the latch is opened, each side 19 and 29 is free to pivot open and receive the antenna/tether cable 3 and lock it against the center tube 15 of the rib assembly 5 of FIG. 4. Note that this center tube should have a slit or opening to allow the cable to slide in from the side rather than be fed in lengthwise through the center of the assembly.

The system of the present invention provides protection of the antenna/tether cable of the VLF communication system of FIG. 1 as well as rapid deployment. This assembly can be quickly and effectively attached and removed from a vertical antenna/tether cable once the balloon is outhauled to an altitude ranging from ground level to 3000 feet or even higher. Once the antenna/tether cable is supported; the feed cable 2 leads are hooked over the vertical strut 11 while the cable is clamped in position by clamp 12 of FIG. 2.

With the feed cable 2 fixed to the dual corona ring assembly, it is slid onto the antenna/tether cable (through the slits in the corona rings) and clamped tight using the quick-lock clamps. After the quick attachment of the corona ring and feed cable, the antenna is then outhauled an additional 12 to 15 feet to provide the base insulation below the suspended ring, discussed above.

In one embodiment of the present invention, the thin wall polyester resin and fiberglass cloth corona ring has a 32 inch outside diameter and a 9.6 inch diameter torus cross-section. The surface of the ring is made conductive by use of an externally applied conductive coating, such as flame sprayed aluminum, and the finished dual-torus corona ring weight was maintained less than 25 pounds. The ring can also be constructed of Kevlar, graphite or any other composite technique. Electrically conductive properties may also be inherent in the materials used in construction, such as graphite, thus eliminating the need for a surface coating.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A dual corona ring assembly for use in a communication system using a tether cable antenna as its transmitting antenns, said communication system having a transmitter with a feed cable to supply a signal to said tether cable antenna, said dual corona ring assembly attaching said feed cable to said tether cable antenna while protecting it from destructive corona discharges, said dual corona ring assembly comprising:

an upper and lower corona ring which are fixed in proximity with each other with a space therebetween to shield said tether cable antenna from said destructive corona discharges, and provide a static-free area at which said feed cable may be connected;

a means for connecting said upper corona ring to said lower corona ring so that they are electrically and mechanically connected, and a means for attaching said feed cable electrically and mechanically to said upper and lower corona rings, said attaching means being located in said space between said upper corona ring and said lower corona ring, said attaching means thereby enabling said upper and lower corona ring to conduct said signal from said transmitter to said tether cable antenna while protecting it from said destructive corona discharges.

2. A dual corona ring assembly, as defined in claim 1, wherein said upper and lower corona rings each comprise:

a hollow annular ring which has a center opening and a conducting outer surface, said hollow annular ring having a rounded radial slit on one side which permits said tether cable antenna to be slid into position at the center opening of the corona rings at any desired position along the tether cable antenna; and center reinforcement ribs housed in said hollow annular ring to provide support, said center reinforcement ribs extending to said center opening and being clamped to said tether cable antenna at said desired positions to hold said hollow annular ring in place.

3. A dual corona ring assembly, as defined in claim 2, wherein each of said center reinforcement ribs comprise:

a center tube fixed in said center opening of said hollow annular ring, said center tube having a longitudinal slit which is aligned with said rounded radial slit of said hollow annular ring to permit said tether cable antenna to be slid into position;

a quick-lock clamp which locks said tether cable antenna to said center tube when said tether cable antenna is slid into position; and reinforcement ribs which are fixed to and extend from said center tube to connect it with said hollow annular ring, said reinforcement ribs extending radially within said hollow annular ring to connect along its circumference and thereby hold it in position with said center tube and said tether cable antenna while electrically and mechanically connecting said hollow annular ring with said tether cable antenna.

4. A dual corona ring assembly, as defined in claim 3, wherein said feed cable has an attachment end with exposed conductive leads which conduct said signal from said transmitter, said exposed conductive leads being rigid hooks and wherein said attachment means of said dual corona ring assembly comprises:

a vertical conductive strut which is fixed to said reinforcement ribs of said upper and lower corona ring, said vertical conductive strut providing an electrical contact to said feed cable when the rigid hooks of its exposed conductive leads are attached on the vertical conductive strut; and a clamp which holds said feed cable in position when the rigid hooks of its exposed conductive leads are clamped on the vertical conductive strut, said clamp being mechanically connected and rigid with respect to the vertical conductive strut.

5. A dual corona ring assembly, as defined in claim 4, wherein said upper and lower corona rings are fixed to said tether cable antenna about twelve to fifteen feet above the ground to provide base insulation to the tether cable antenna to protect it from said signals from said transmitter.

6. A dual corona ring assembly, as defined in claim 5, wherein said tether cable antenna extends at a height approximately equaling $\lambda/4$ where $\lambda$ is a wavelength of said signals from said transmitter.

7. A dual corona ring assembly, as defined in claim 6, wherein said hollow annular ring is composed of polyester resin and fiberglass cloth and has its outer surface sprayed with an electrically conductive coating.

8. A dual corona ring assembly, as defined in claim 6, wherein said hollow annular ring is composed of composite materials containing graphite or other conductive compounds, which provides said conductive outer surface.

* * * * *